US006006499A

United States Patent [19]

Rämö et al.

[11] Patent Number: 6,006,499

[45] Date of Patent: Dec. 28, 1999

[54] APPARATUS FOR SEPARATING A STACK PORTION WITH A SEPARATOR ELEMENT AND A DEVICE FOR GRIPPING A PROTRUDING MARKER

[75] Inventors: Jouni Rämö , Humppila; Jouni Suokas, Tammela, both of Finland

[73] Assignee: Jomet Oy, Forssa, Finland

[21] Appl. No.: 08/682,718

[22] PCT Filed: Jan. 25, 1995

[86] PCT No.: PCT/FI95/00032

§ 371 Date: Jul. 29, 1996

§ 102(e) Date: Jul. 29, 1996

[87] PCT Pub. No.: WO95/20523

PCT Pub. Date: Aug. 3, 1995

[30] Foreign Application Priority Data

Jan. 28, 1994 [FI] Finland ..... 940416

[51] Int. Cl.[6] ..... B65B 35/30

[52] U.S. Cl. ..... 53/448; 53/542

[58] Field of Search ..... 53/448, 542

[56] References Cited

U.S. PATENT DOCUMENTS

| | | | |
|---|---|---|---|
| 3,000,151 | 9/1961 | Winkler et al. | 53/542 X |
| 3,562,775 | 2/1971 | Mullins . | |
| 3,648,431 | 3/1972 | Hartbauer et al. | 53/542 X |
| 3,826,348 | 7/1974 | Preisig et al. . | |
| 4,332,124 | 6/1982 | Jaton | 53/542 X |
| 4,623,292 | 11/1986 | Suzuki et al. . | |
| 4,765,451 | 8/1988 | Labombarde | 53/542 X |
| 4,810,153 | 3/1989 | Armelin . | |
| 4,873,813 | 10/1989 | Labombarde et al. | 53/542 X |
| 4,877,367 | 10/1989 | Cinotti . | |
| 4,879,862 | 11/1989 | Nolte et al. . | |
| 5,017,085 | 5/1991 | Ishikawa . | |
| 5,102,293 | 4/1992 | Schneider . | |

FOREIGN PATENT DOCUMENTS

| | | |
|---|---|---|
| 87438 | 6/1988 | Finland . |
| 1 375 325 | 11/1974 | United Kingdom . |

*Primary Examiner*—Daniel B. Moon

*Attorney, Agent, or Firm*—Pollock, Vande Sande & Amernick

[57] ABSTRACT

An apparatus for packaging article goods, such as paper goods, forming a stack comprises a conveyor adapted to carry a continuous stack formed by identical individual articles, such as envelopes, and a displacer device located along one side of the stack advancing path and provided with a detector for a count article constituted by one of identical articles and protruding from the stack. A separator element is adapted to penetrate into the stack for producing a gap between a stack portion to be separated first from the stack and the rest of the stack. The apparatus also includes a pusher element which is located at the front of the separator element in the advancing direction of the conveyor and is adapted to move across the stack advancing path for displacing the stack portion to a further processing unit located along the other side of the advancing path. The separator element is aligned with a gripper which is adapted to clasp the protruding count article and then release it to be left in the stack.

5 Claims, 4 Drawing Sheets

APPARATUS FOR SEPARATING A STACK PORTION WITH A SEPARATOR ELEMENT AND A DEVICE FOR GRIPPING A PROTRUDING MARKER

FIELD OF THE INVENTION

The present invention relates to an apparatus for packaging article goods forming a stack.

BACKGROUND OF THE INVENTION

The Finnish patent 87438 discloses an apparatus which utilizes a count object (article) for packaging envelopes in batches of a certain size, the count object (article) being pushed out at fixed spaces when feeding the envelopes into a continuous stack advancing on a conveyor and having the envelopes in a vertical plane. This type of apparatus is also known from the U.S. Pat. No. 3,562,775. The principle in these solutions is the use of a special detector for detecting the arrival of the count object in a separation zone, followed by pushing an elongated separator element through the entire width of the stack transversely to the stack advancing direction for separating from the leading end of the stack a stack portion of a certain size, which is pushed aside for further processing in the operation of packaging the same.

A gap is formed by means of the separator element preferably between the counting object and the leading end of a stack in front of it. In order to separate this stack portion to form a distinctly detached unit, the separator element must produce a sufficiently clear gap. The prior art solutions have employed separator elements which penetrate into a stack through its entire width. In addition, the Finnish patent 87438 discloses a solution in which the separator element is further divided into two horizontal blades for supporting the stack both in the upper and lower part. This ensures that the stack portion remains well separated as the conveyor pushes a continuous stack into the separation zone.

SUMMARY OF THE INVENTION

An object of the invention is to introduce a novel type of apparatus capable of providing equally good separation without having to provide respective elements with movement ranges that would be as long as those used before. In order to achieve this object, in an apparatus of the present invention the displacer device, which is adapted to carry out the separation, is provided with a special gripper adapted to hold on to the protruding edge of the count object. This provides a firm grip of the stack and, thus, the separator element can produce a distinct separation between the stacks. This is a relatively expedient way of producing a sufficiently distinct separation point at the other edge of the stack so that a pusher element located alongside this edge is able to displace the thus separated stack portion aside. At the same time, the gripper holding on to the count object ensures that the count object and the following objects in the stack do not come along.

The invention will now be described in more detail with reference made to the accompanying drawings, in which

BRIEF DESCRIPTION OF THE DRAWING(S)

DETAILED DESCRIPTION OF THE PREFERRED EMBODIMENT(S)

Figure 2:
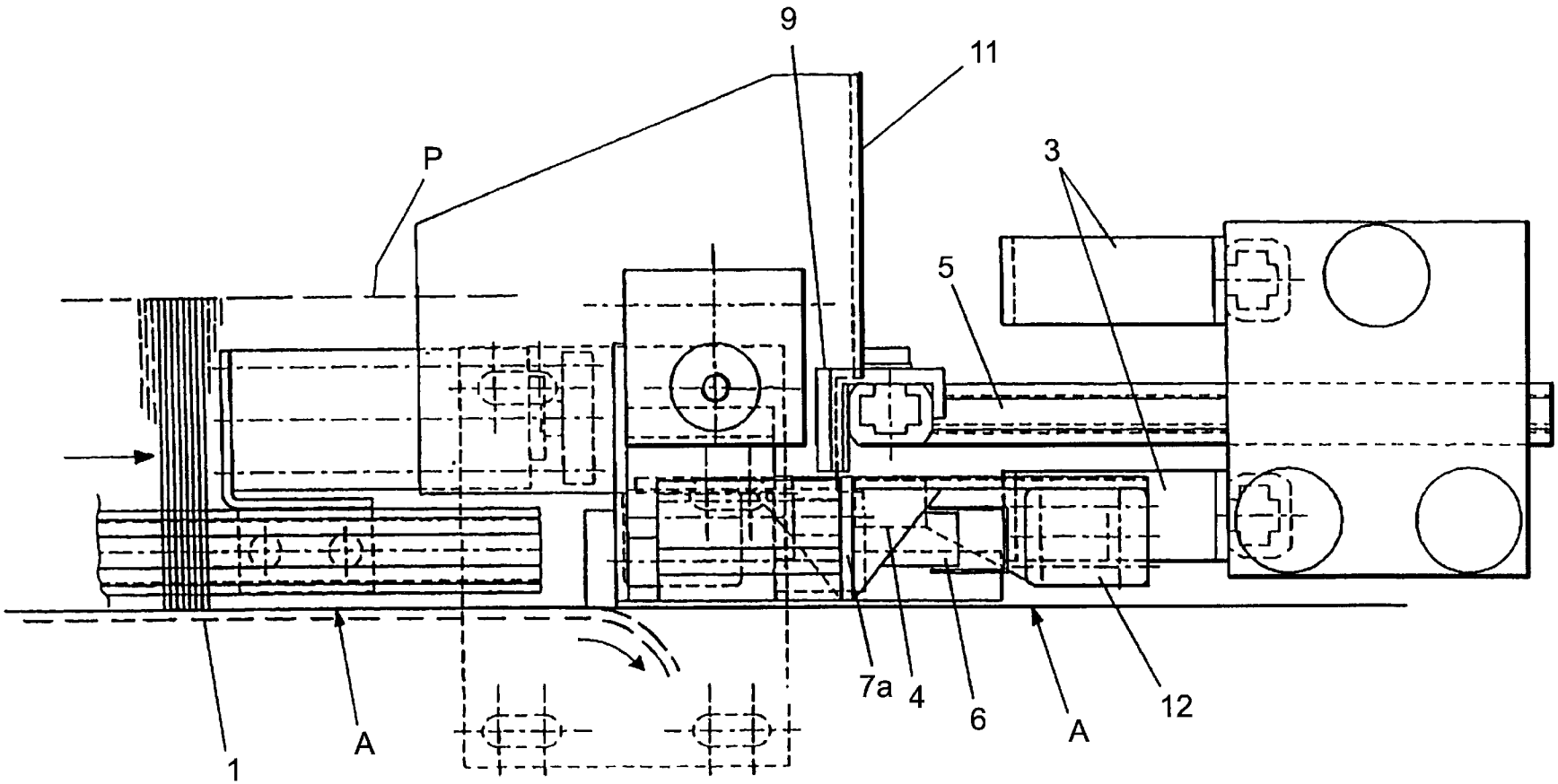
FIG. 2 shows the present invention apparatus from the direction of a pusher element.

The illustrated apparatus comprises a conveyor 1, such as a belt conveyor advancing e.g. at a table top level A (FIG. 2). The conveyor is supplied with article goods, comprising flexible thin articles, generally paper goods, into a continuous stack P in such a manner that the individual articles form a stack resting against the conveyor and having the articles in a vertical plane. For example, in a fabrication apparatus for envelopes, in reference to which the invention will be described hereinbelow, one object or specimen 2 is pushed at fixed spaces to form a count object article protruding from the stack for a subsequent sorting operation. The feeding apparatus for effecting this is prior known and, in this respect, reference is made e.g. to the Finnish patent 87438 and U.S. Pat. No. 3562775.

The conveyor 1 terminates upstream of a displacement area which can be an extension of the same table that the advancing conveyor 1 is at level with. The apparatus includes a displacer device for separating stack portions in the displacement area and for displacing the same aside for subsequent operations. The continuous stack advances on top of a table into the displacement area under the action of the conveyor 1 and is held at this point in a sufficiently compressed condition by a counterweight 3, adapted to travel under the control of guides extending parallel to the stack advancing direction and to compress against the first specimen or object of the stack by an appropriately produced force, such as a spring force, a suspended weight pulling the counterweight by way of a rope, or the counterweight's own, sufficiently great mass.

Figure 1:
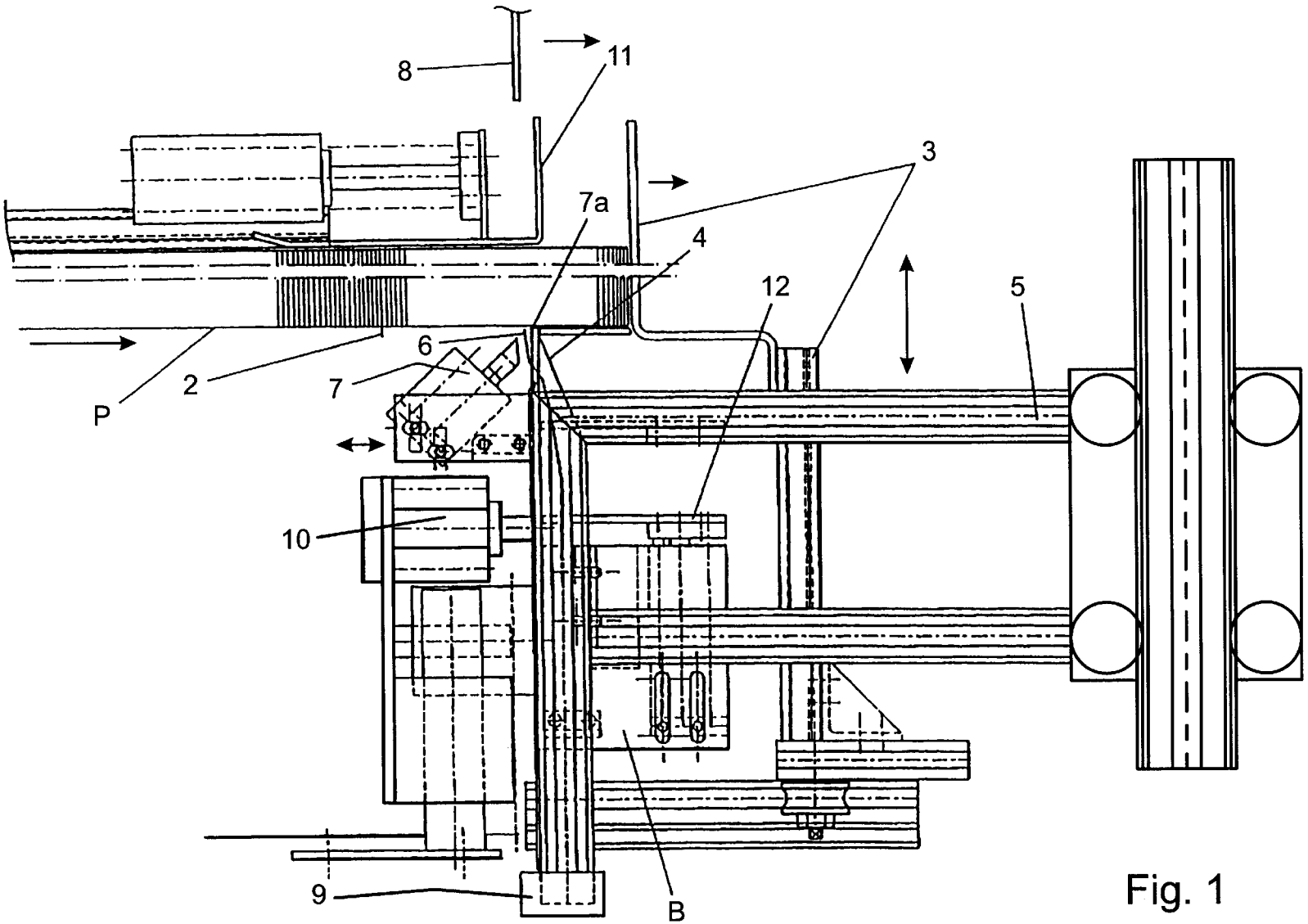
FIG. 1 shows the apparatus from above.

The displacer device is located along one side of the stack advancing path and includes a separator element 4, comprising a separating wedge penetrating into the stack from the side, as well as a pusher element 5 for pushing a stack portion formed in the displacement area between the separating wedge and the counterweight 3 aside for further processing, for example into the range of action of a gripper. One of the jaws of the gripper being shown in FIG. 1 by reference numeral 8. The displacer device is also provided with a detector 6 for the edge of a count object, positioned so that the count object 2 comes into contact therewith as the stack advances whereby the detector 6 produces a signal. The detector can be e.g. a conventional micro-switch operating on the contact principle. The signal is transmitted to a gripper 7 for clasping its jaws around the edge of the count object 2. The gripper 7 is located at the bottom portion of the stack and, immediately after the gripper has completed its action, the above-mentioned separator element 4 penetrates into the stack just before the count object 2 for producing a gap between the gripper-held count object 2 and a stack portion downstream thereof. The separator element 4 only penetrates through a part of the stack width, a small distance from the outer stack edge towards the interior. As shown especially in FIG. 4, one jaw of the gripper comprises a plate 7*a* placing itself transversely across the advancing path of the count object 2 and the other jaw comprises a nose 7*b* extending towards the plate from the stack incoming direction and having its end bevelled to align with the surface of the plate 7*a*.

The gripper 7 and the separator element 4 can be stationary in the apparatus, the direction of movement of the separating wedge being slightly slanting against the stack advancing direction for producing a sufficient gap. According to a preferred embodiment, those can be made movable by means of an actuator against the stack incoming direction, whereby the separating wedge may move perpendicularly to the stack advancing path. The figures depict an embodiment, wherein the gripper 7 and the separator element 4 as well as an actuator 12 for operating the latter are included in a common sub-frame B which is movable by means of a common actuator 10 mounted on the body of the displacer device, the components moving together against the advancing direction of the conveyor 1. This action for producing a preliminary gap is timed to take place as soon as the gripper 7 has taken hold of the count object 2. The separator element 4 penetrates a small distance into the stack at the end of the sub-frame movement under the pushing action from the actuator 12.

Figure 3:
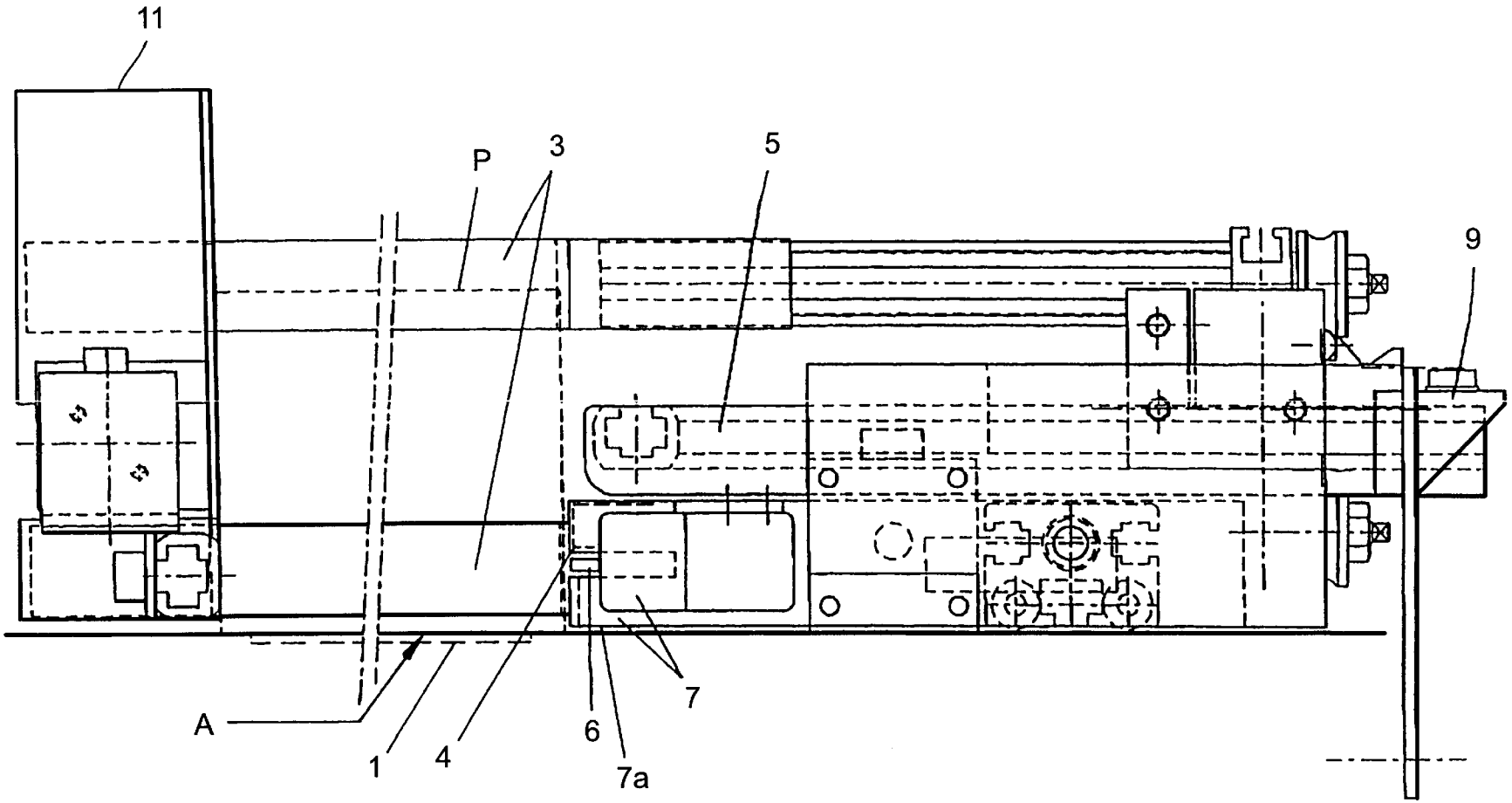
FIG. 3 shows the apparatus from the incoming direction of a conveyor.
Figure 4:
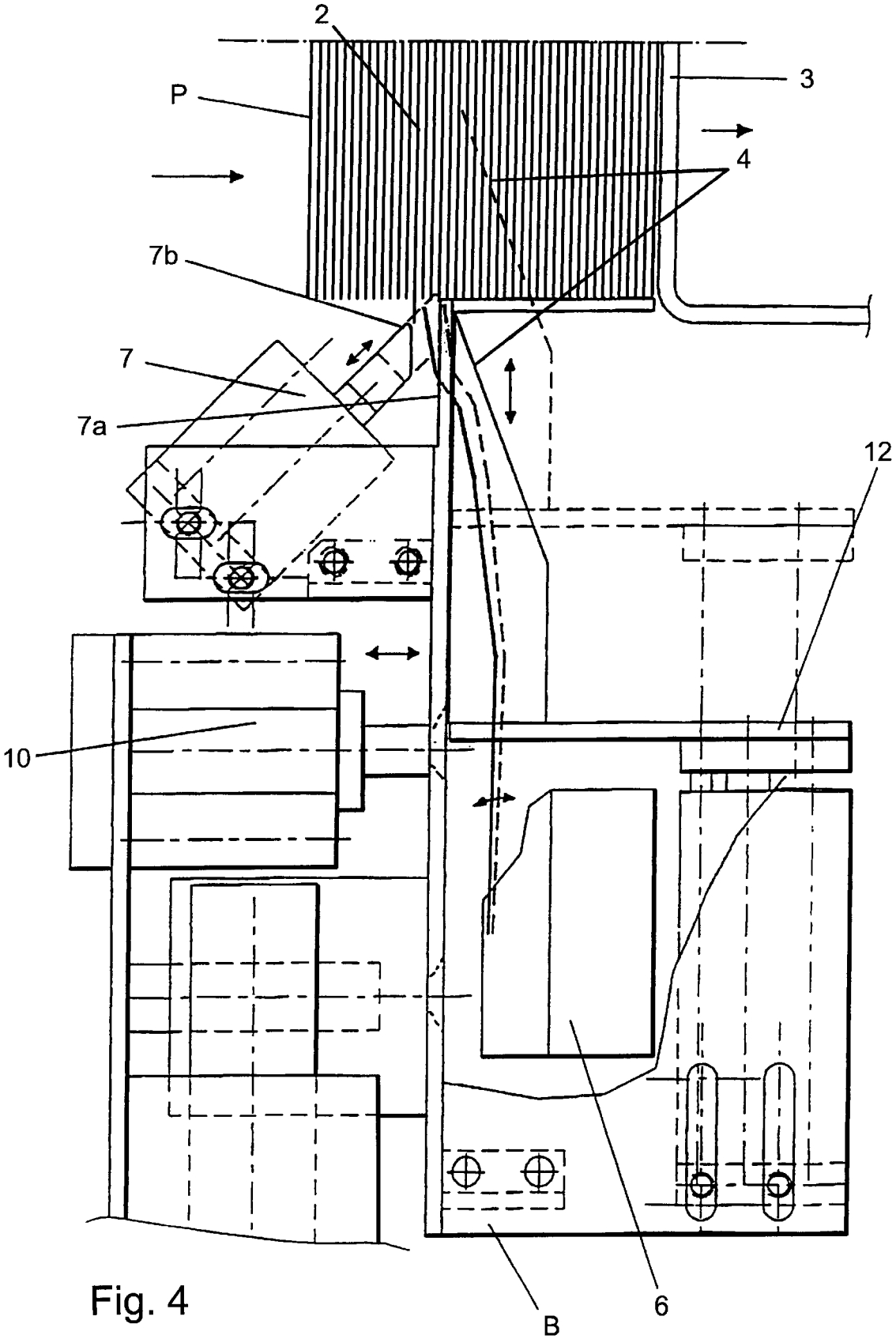
FIG. 4 shows a separator element and a gripper in more detail from above.

FIGS. 3 and 4 further depict the disposition of components included in the sub-frame B: the plate 7*a* forming the fixed jaw for the gripper is provided with a recess, wherethrough a strip-like sensor element included in the detector 6 extends from the surface of the plate 7*a* further in the stack incoming direction and produces the action of the moving component of the gripper 7 when being compressed backwards under the pushing action from the count object 2.

The separator element 4 is located in front of the plate 7*a* and its surface facing the stack incoming direction is perpendicular to the stack advancing direction. When the gripper 7 and the separator element 4 have accomplished the separation of a stack portion, the front face of the pusher element 5, which is parallel to the stack edge, pushes the stack portion from between the count object 2 and the counterweight 3 into the operating range of the gripper performing the final packaging. The counterweight 3 includes a backing surface which extends in the pushing direction for guiding the stack portion together with an opposing adjustable backing 11. The pusher element 5 can be e.g. a horizontal frame, assembled from metal profiles and mounted on the body of the displacer device so as to effect a reciprocating action by means of an actuator along guides that are perpendicular to the conveyor advancing direction. During the pushing action, the separator element 4 and the gripper 7 return to the initial position assumed prior to motions or actions effected by the count object 2, and the gripper 7 releases the count object 2, which at the same time, comes into contact with the side face of the pusher element through the action of the conveyor. This side face is also provided with a protrusion 9 for setting the free-movement capable counting object 2 flush with the rest of the stack. When the stack portion has left the separation zone, the counterweight 3 is again able to move against the first specimen or object of the stack arriving on the sorting table, the specimen being the count object 2 that has been set flush with the rest of the stack in the abovementioned manner. At the same time, the pusher element 5 also retracts. As shown in FIGS. 2 and 3, the counterweight 3 is provided with backing surfaces, located above and below the pusher element 5 and fastened to a carriage movable on the body of the displacer device. The pusher element 5 and the counterweight 3 can be positioned so as not to interfere with each other's actions. The return action of the counterweight 3 can also be accomplished by its own cylinder, which is actuated when the pusher 5 is sufficiently far away.

Thereafter, the stack P advances on the sorting table until the next count object 2 reaches the detector 4 and the same operations are repeated.

The actions of various components in the apparatus and the synchronization thereof can be accomplished by means of actuators and control elements known from automatics. The actuators producing the actions of various components can be provided e.g. by using pneumatic cylinders.

The conveyor 1 can be in a continuous motion during the above displacement actions since the material in a stack is capable of compressing when a stack portion is separated, the count object 2 not able to advance forward.

Although described above with reference made to packaging envelopes, the invention can be applied for packaging any paper goods or article goods forming a stack which is characterized by count objects protruding from the stack at set spaces.

We claim:

1. An apparatus for packaging article goods forming a stack, comprising:

a conveyor for carrying a continuous stack, formed by identical articles disposed in a vertical plane, in an advancing direction of the conveyor parallel to a table top level;

a displacer device positioned along one side of a stack advancing path and provided with a detector for detecting a count article constituted by one of the identical articles of the stack, and protruding from the stack to determine a stack portion to be separated downstream of the count article;

a separator element for penetrating into the stack and for producing a gap between a stack portion to be first separated from the stack and the rest of the stack, and a pusher element which is located at the front of the separator element in the advancing direction of the conveyor, and adapted to move across the stack advancing path for displacing said separated stack portion to a further processing unit located along the other side of the stack advancing path, and wherein the separator element is aligned with a gripper which is adapted to clasp the protruding count article and to release the count article to leave it in the stack.

2. An apparatus according to claim 1, wherein in a clasping position said gripper is adapted to move against the advancing direction of the conveyor.

3. An apparatus according to claim 1, wherein the separator element is movable together with the gripper.

4. An apparatus according to claim 1, wherein a pushing action of the separator element is limited to just a portion of a width of the stack.

5. A method for packaging article goods forming a stack, said method comprising the steps of:

carrying by a conveyor a continuous stack resting against the conveyor and comprised of identical individual articles disposed in a vertical plane in a direction parallel to a table top level to a displacement area, displacing stack portions aside for subsequent operations with the help of articles protruding from the stack to determine a stack portion to be separated downstream of the count articles and forming count articles which are identical with the articles in the stack, detecting said count articles with a detector for displacing a stack portion in front of the count article aside, and forming a gap between the displaced stack portion and the rest of the stack by taking hold of the count article by a gripper and by moving the gripper against the advancing direction of the conveyor, whereafter the count article is released and left in the stack.

* * * * *